US010787937B2

(12) United States Patent
Lindner

(10) Patent No.: US 10,787,937 B2
(45) Date of Patent: Sep. 29, 2020

(54) METHOD AND SYSTEM FOR TRANSFORMING HEAT INTO KINETIC ENERGY

(71) Applicants: Lutz Lindner, Zschorlau OT Burkhardtsgrün (DE); Carmen Lindner, Zschorlau OT Burkhardtsgrün (DE)

(72) Inventor: Lutz Lindner, Zschorlau OT Burkhardtsgrün (DE)

(73) Assignees: Lutz Lindner, Zschorlau OT Burkhardtsgr (DE); Carmen Lindner, Zschorlau OT Burkhardtsgr (DE)

( * ) Notice: Subject to any disclaimer, the term of this patent is extended or adjusted under 35 U.S.C. 154(b) by 71 days.

(21) Appl. No.: 16/172,919

(22) Filed: Oct. 29, 2018

(65) Prior Publication Data

US 2019/0128148 A1 May 2, 2019

(30) Foreign Application Priority Data

Oct. 29, 2017 (DE) ..... 10 2017 125 355

(51) Int. Cl.

| | |
|---|---|
| ***F01K 25/06*** | (2006.01) |
| ***F01K 21/04*** | (2006.01) |
| ***F01K 9/00*** | (2006.01) |
| ***F01K 25/04*** | (2006.01) |
| ***F01D 15/10*** | (2006.01) |

(Continued)

(52) U.S. Cl.

CPC ..... *F01K 25/065* (2013.01); *F01D 15/10* (2013.01); *F01K 9/003* (2013.01); *F01K 11/00* (2013.01); *F01K 13/006* (2013.01); *F01K 21/04* (2013.01); *F01K 25/04* (2013.01); *F01K 25/06* (2013.01);

(Continued)

(58) Field of Classification Search

CPC ..... F01K 25/065; F01K 25/08; F01K 13/006; F01K 11/00; F01D 15/10

See application file for complete search history.

(56) References Cited

U.S. PATENT DOCUMENTS 8,272,217 B2 * 9/2012 Lengert ..... F01K 25/065 60/649
9,797,273 B2 * 10/2017 Nishiguchi ..... C09K 5/045 60/641.8

(Continued)

FOREIGN PATENT DOCUMENTS

DE 202012003471 U1 8/2013
WO 2011097257 A2 8/2011

*Primary Examiner* — Shafiq Mian

(74) *Attorney, Agent, or Firm* — Michael Soderman

(57) ABSTRACT

A method and system enabling the efficient use of thermal energy to provide kinetic energy and/or electrical energy. The method uses at least two heat exchangers for heating the working medium, a heat engine and a condenser. The working medium consists of at least two substances. The working medium is partially condensed on the primary side of the first heat exchanger, wherein heat is transferred to the working medium flowing on the secondary side and, subsequently, further condensation heat is transferred to a cooling circuit in a condensation heat exchanger on the primary side of the condensation heat exchanger. Subsequently, the working medium is redirected to the secondary side of the first heat exchanger. A separation of gaseous fractions of the working medium takes place in the condensation heat exchanger on the primary side.

6 Claims, 2 Drawing Sheets

(51) Int. Cl.

| | |
|---|---|
| ***F01K 11/00*** | (2006.01) |
| ***F01K 13/00*** | (2006.01) |
| ***F01K 25/08*** | (2006.01) |
| *F22B 9/00* | (2006.01) |
| *F01K 19/00* | (2006.01) |

(52) U.S. Cl.
CPC ..... *F01K 25/08* (2013.01); *F01K 19/00* (2013.01); *F22B 9/00* (2013.01)

(56) References Cited

U.S. PATENT DOCUMENTS

| | | | | |
|---|---|---|---|---|
| 9,926,813 | B2 * | 3/2018 | Williams | F01K 25/08 60/645 |
| 2007/0022753 | A1 * | 2/2007 | Lengert | F01K 25/065 60/645 |
| 2010/0287969 | A1 * | 11/2010 | Ueda | F25B 1/10 62/324.6 |
| 2013/0186597 | A1 | 7/2013 | Clark et al. | |
| 2014/0223911 | A1 * | 8/2014 | Ikegami | F01K 7/38 60/671 |
| 2018/0353873 | A1 * | 12/2018 | Goldshtein | F01K 9/003 60/645 |

* cited by examiner

METHOD AND SYSTEM FOR TRANSFORMING HEAT INTO KINETIC ENERGY

CROSS REFERENCE TO RELATED APPLICATIONS

This application claims the priority of DE 102017125355.6 filed on 2017 Oct. 29; this application is incorporated by reference herein in its entirety.

BACKGROUND

The invention concerns a method and an arrangement for converting heat into kinetic energy using at least two heat exchangers to heat the working medium, a heat engine and a condensation heat exchanger.

Methods and arrangements for converting heat into kinetic energy using at least two heat exchangers to heat the working medium, a heat engine, and a condensation heat exchanger are known in different versions.

For example, the Kalina cycle, in which a mixture of water and ammonia, for example, is evaporated in a steam generator, is known. For example, a system for generating electricity with an ORC or a Kalina cycle is known from DE 20 2012 003 471 U1.

The WO 2011/097 257 A2 reveals systems and processes for converting heat from external heat source flows or solar energy derived from a solar collector subsystem. The systems and methods comprise a thermodynamic cycle with three internal subcycles. Two of the subcycles together form a higher pressure turbine and the third or main cycle drives a turbine with lower pressure. One of the cycles increases the flow rate of a richer working solution flow that drives the low-pressure turbine. Another cycle is a leaner working solution cycle that provides an increased flow rate for the leaner working solution flow entering the high-pressure turbine. A disadvantage here is that ammonia and water are used, which have a very high energy storage capacity resulting in a high energy requirement for evaporation.

The US 2013/0 186 597 A1 reveals pressurized gas storage units that can be used in certain applications in conjunction with energy storage systems. These pressurized gas storage units may include one or more blow-molded polymer shells formed from, for example, polyethylene terephthalate (PET) or ultrahigh molecular weight polyethylene (UHMWPE). Other pressurized gas storage units may be of composite nature, such as carbon fiber filaments wrapped with a resin over a liner. A pressurized gas storage unit may further comprise a heat exchanger element comprising a heat pipe or device configured to introduce liquid directly into the storage unit for heat exchange with the compressed gas present therein.

DE 20 2012 003 471 U1 reveals a system for generating electricity by coupling to an ORC or Kalina cycle, and, preferably, for generating heating heat, with a working circuit carrying a working medium, with a motor and with a generator, wherein the working circuit comprises at least one first heat exchanger for transferring heat to the working medium, wherein the working medium is at least partially evaporated by heat transfer, wherein energy is delivered to the engine as volume change energy by expanding the working medium, and wherein kinetic energy of the engine is transferred to the generator and converted into electrical energy by the generator, whereby the engine has as a reciprocating piston engine a crankshaft arrangement and at least one pressure segment, whereby the pressure segment is periodically movable in the direction towards the crankshaft and away from the crankshaft and comes periodically into contact with a driver part connected to the crankshaft, whereby a compressive force acting on the driver part and a torque acting on the crankshaft are generated in the contact state by the pressure segment, whereby the pressure segment fits closely to the driver part in the contact state, wherein the volume change energy is carried out to the pressure segment during the expansion of the working.

SUMMARY

The purpose of this invention is to provide a method and an arrangement enabling the efficient use of thermal energy to provide kinetic energy and/or electrical energy. Method for converting heat into kinetic energy using at least two heat exchangers (1, 2) for heating the working medium, a heat engine (3) and a condenser (4), whereby the working medium consists of at least two substances, a first heat energy is supplied in a first heat exchanger (1) to the working medium flowing on the secondary side (1*s*), whereby the working medium is at least partially evaporated and a second heat energy is supplied in a second heat exchanger (2) to the working medium flowing on the secondary side (2*s*), whereby the working medium is further evaporated, the working medium evaporated at least to a great extent is subsequently led into the heat engine (3) and there performs mechanical work during pressure release, then the working medium is partially condensed on the primary side (1*p*) of the first heat exchanger (1), whereby heat is transferred to the working medium flowing on the secondary side (1*s*) and, subsequently, further condensation heat is transferred to a cooling circuit (5) in a condensation heat exchanger (4) on the primary side (4*p*) of the condensation heat exchanger (4) and, subsequently, the working medium is redirected to the secondary side (1*s*) of the first heat exchanger (1), wherein in the condensation heat exchanger (4) on the primary side (4*p*), a separation of gaseous fractions of the working medium takes place and the separated gas finely dispersed is injected by a gas blower (6) directly upstream or in the first heat exchanger (1), wherein a foaming agent is added to the working medium.

DETAILED DESCRIPTION

The purpose of this invention is to provide a method and an arrangement enabling the efficient use of thermal energy to provide kinetic energy and/or electrical energy.

The invention solves the problem with the features explained below.

The invention concerns a method and an arrangement for converting heat into kinetic energy using at least two heat exchangers to heat the working medium, a heat engine and a condensation heat exchanger.

According to the invention, the working medium consists of at least two substances with different boiling points, such as water and alcohol at about 50% each or a chlorofluorocarbon (CFC)-free or CFC-containing refrigerant. CFC-free refrigerants or refrigerants containing CFC are known, for example, from cooling systems, air conditioning systems, or heat pump systems. The working medium can be a refrigerant as a single component refrigerant in combination with at least one other medium or a multi-component refrigerant, which alone is a working medium consisting of at least two substances with different boiling points or which is used in combination with at least one other medium. The working medium is conducted in a closed circuit. First, a first thermal energy is supplied to the working medium flowing on the secondary side in a first heat exchanger, whereby the working medium is evaporated at least partially, and then a second thermal energy is supplied in a second heat exchanger to the working medium flowing here likewise on the secondary side, whereby the further evaporation of the working medium occurs. The boiling point of the water is reduced by alcohol as a component of the working medium resulting in the increase of the steam generation efficiency. The working medium evaporated at least to a great extent is fed into the heat engine, such as a turbine or a displacement machine, where it performs mechanical work by tension release. The relieved working medium is then directed to the primary side of the first heat exchanger where it partially condenses. In particular, the component of the working medium condenses at the higher boiling point, such as water. The discharged thermal energy is transferred to the working medium flowing on the secondary side in the first heat exchanger as the first heat quantity. Thus a heat recovery takes place, which causes the condensation of the component of the working medium with the higher boiling point and at the same time uses the heat for the evaporation of the component with the lower boiling point. This improves the efficiency of the cycle process. Subsequently, further condensation heat is detracted from the working medium in a condensation heat exchanger on the primary side and transferred to a cooling circuit. In order to close the circuit, the working medium is again directed to the secondary side of the first heat exchanger.

It is advantageous to separate the gaseous components of the heat carrier in the condensation heat exchanger on the primary side. The separated gas is injected finely dispersed by a gas injector directly in front of or in the first heat exchanger, whereby a foaming agent is added to the working medium. The foam formation improves the evaporation. The surface increased by the foam improves the heat transfer. The gas for foam formation is obtained from the closed circuit, whereby the energy for compression is used by increasing the temperature of the gas. This allows to work with lower temperature differences between flow and return. The overall efficiency of the cycle process is thus increased.

Furthermore, the invention purpose is solved by providing a method for the implementation of a cooling circuit with a cooling tower.

The method provides that the cooling medium heated in a heat exchanger, here the condensation heat exchanger, is led into a cooling tower, whereby the cooling medium is mixed with a foaming agent. Outside air is blown in via a cooling tower blower, which foams up the cooling medium. The air trapped in the foam heats up so that the foamed cooling medium then rises to a collecting tank as a result of the buoyancy. The foamed cooling medium is subsequently guided by the spray jets of a sprayer arranged above the collecting tank, so that the foam is dissolved by the spray jets and gaseous cooling medium condenses at the same time. Subsequently, the liquid is led out of the collecting tank via a water turbine and subsequently returned to the heat exchanger. The water turbine can thus be used to provide mechanical energy, for example to drive a generator.

The inventive method provided utilizes the potential energy of the condensing steam, while at the same time increasing the proportion of cooling water recovered by condensation. This in turn increases the overall efficiency of the system. At the same time, the cooling water requirement is reduced by condensation and recovery of the cooling water in the collecting tank.

Furthermore, the invention purpose is provided by the provision of an arrangement for carrying out the processes. The arrangement provides that a first heat exchanger on the secondary side is connected to a second heat exchanger on the secondary side and the second heat exchanger on the secondary side is connected to the pressure side of a heat engine. The connections are made by pipelines carrying the respective medium. The relief side of the heat engine is connected to the primary side of the first heat exchanger and then the primary side of the first heat exchanger is connected to the primary side of a condensation heat exchanger. The condensation heat exchanger is in turn connected to a cooling circuit on the secondary side and then the primary side of the condensation heat exchanger is connected to the secondary side of the first heat exchanger. By this way, a closed circuit of the working medium is implemented and enables the advantageous execution of the method for converting heat into kinetic energy.

According to the arrangement of the invention, the working medium is a mixture of at least two substances with different boiling points. At least two substances are evaporated during the process and condensed again after the mechanical work has been carried out. Due to the different boiling points, the thermodynamic advantages of the method for converting heat into kinetic energy can be used efficiently. Preferably, for example, the working medium components are water and alcohol, each at about 50%. In addition, for example, air may be entrained. A Stirling process is carried out in parallel by the entrained air. However, the working medium can also be a CFC-free or CFC-containing refrigerant. As described above, the working medium can also be a refrigerant as a single component refrigerant in combination with at least one other medium or a multi-component refrigerant.

The secondary side of the first heat exchanger and the secondary side of the second heat exchanger are formed in a tank in accordance with the further advantageous invention improvement. This enables a compact arrangement of the steam generator to be implemented in this way. Due to the compact tank arrangement of the heat exchangers, the advantages of foam formation in particular may be used for the cycle process.

According to the preferred arrangement of the invention, the primary side of the condensation heat exchanger is equipped with an air separator. The air separator is connected to a gas blower arranged on the secondary side of the first heat exchanger. Furthermore, a foaming agent is added to the heat carrier. The secondary side of the second heat exchanger is arranged above the secondary side of the first heat exchanger. This arrangement allows the foam formation of the working medium and the resulting thermodynamic advantages for the cycle process.

The purpose is further solved by providing an arrangement for carrying out the process according to a further embodiment. The arrangement provides that a cooling circuit carrying a cooling medium is connected to a cooling tower blower arranged at the bottom of a cooling tower. The cooling tower blower is connected to a compressor/blower in order to draw in outside air and supply it to the blower in the cooling tower. This allows the cooling medium mixed with a foaming agent to be foamed up. Furthermore, a sprayer is arranged in the head of the cooling tower above a collecting tank equipped with an air exhaust. The collecting tank is connected to a water turbine by a downpipe. The arrangement enables the extraction of mechanical energy in the water turbine and thus the advantageous implementation of this method.

BRIEF DESCRIPTION OF THE DRAWINGS

Advantageous arrangement examples of the invention are explained in detail based on drawings. The following is shown.

DETAILED DESCRIPTION OF THE PREFERRED EMBODIMENTS

Figure 1:
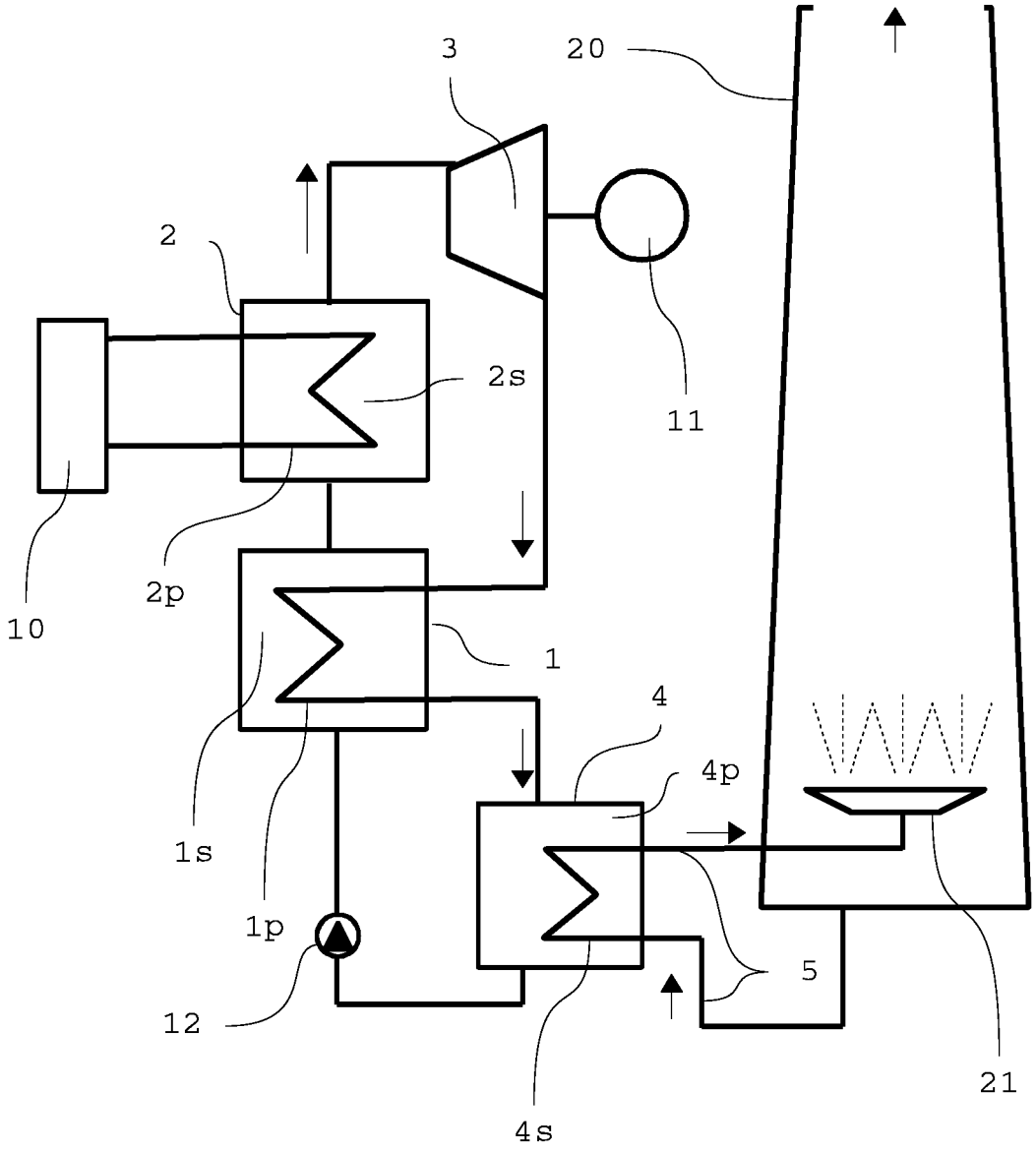
FIG. 1 a schematic diagram of an arrangement for converting heat into kinetic energy with a cooling tower and FIG. 2 a schematic diagram of a modified arrangement for converting heat into kinetic energy.

FIG. 1 shows a schematic diagram of an arrangement for converting heat into kinetic energy. The arrangement consists of two heat exchangers 1, 2 for heating the working medium composed of two substances with different boiling points, a heat engine 3 and a heat exchanger 4 acting as condenser 4. The heat exchangers 1, 2, 4 are tanks connected with a tube bundle or a spiral tubes for heat transfer. On the primary side 1*p*, 2*p*, 4*p* heat is supplied to the heat exchanger 1, 2, 4. On the secondary side 1*s*, 2*s*, 4*s*, the working medium to be heated and, if necessary, evaporated is connected to the respective heat exchangers 1, 2 by means of pipe assemblies. The heating of the working medium is referred to as the flow. The area downstream of the heat engine 3, in this case the turbine 3, is referred to as the return flow.

The working medium is preferably a mixture of about 50% water and about 50% alcohol. In the first heat exchanger 1, the working medium flowing in on the secondary side is heated, whereby it partially evaporates. In particular, the part of the working medium with the lower boiling temperature evaporates. Part of the working medium with the higher boiling temperature also partially evaporates.

First the flow of the working medium is described.

On the primary side 1*p*, heat is supplied to the first heat exchanger 1. For this purpose, the first heat exchanger 1 is connected on the primary side with the return flow from the heat engine 3 designed as turbine 3. The working medium flowing on the secondary side is partially evaporated. In particular, the part of the working medium with the lower boiling temperature evaporates.

In a second heat exchanger 2 connected in series to the first heat exchanger 1, heat from a heat source flow 10 is supplied to the working medium. The heat source flow 10, for example, is a combustion system 10. With the supplied heat, the working medium is further evaporated and, if necessary, superheated. The working medium is then led to a steam turbine 3 in which it expands and performs work which is used here to drive a generator 11.

The return flow is described below. The released steam is passed on the primary side 1*p* over the first heat exchanger 1, where it partially condenses. In particular, the working medium condenses with the higher boiling temperature. As described above, the heat is provided to heat the working medium flowing on the secondary side 1*s*.

Subsequently, the working medium is conducted from the primary side 1*p* of the first heat exchanger 1 to the primary side 4*p* to the condensation heat exchanger 4. The condensation of the working medium occurs in the condensation heat exchanger 4. For this purpose, the condenser heat exchanger 4 is connected to a cooling circuit 5 on the secondary side 4*s*. Here the cooling circuit 5 is coupled with a cooling tower 20, in which the cooling water partially condenses and may thus partially be reused for the cooling of the condenser heat exchanger 4. Subsequently, the condensed working medium is fed via a feed pump to the secondary side 1*s* of the first heat exchanger 1. The feed pump 12 is preferably used to increase the pressure of the working medium.

Figure 2:
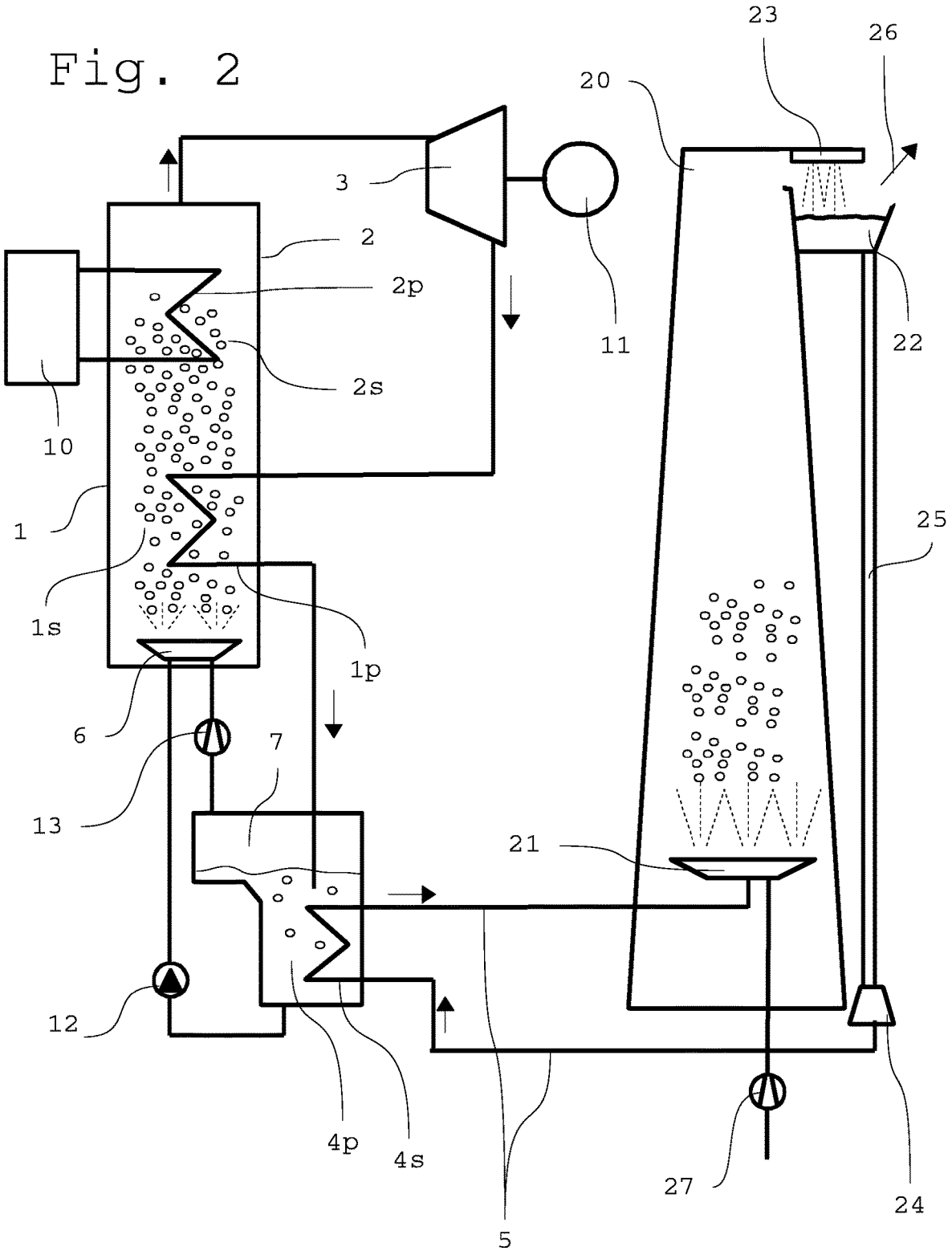

FIG. 2 shows a schematic diagram of a modified and improved arrangement for converting heat into kinetic energy. Essentially, the arrangement shown here corresponds to the arrangement known from FIG. 1. In the following, the differences compared to FIG. 1 are described in particular.

Here the secondary side 1*s* of the first heat exchanger 1 and the secondary side 2*s* of the second heat exchanger 2 are structurally combined in one tank, which here form the steam generator. Furthermore, a gas blower 6 is arranged at the bottom of the tank in the area of the secondary side 1*s* of the first heat exchanger 1.

The gas blower 6 is intended to inject gaseous heat carrier and/or air into the working medium by means of a compressor/blower 27. This foams the working medium, supported by a foaming agent added to the working medium. Foaming increases the surface area and thus improves the heat transfer to the working medium. At the same time, the foam rises to the second heat exchanger as a result of heating, where it continues to evaporate. The second heat exchanger 2 is connected on the primary side 2*p* to a heat source 10, such as a heating device. Foaming improves the efficiency of the evaporation of the working medium.

The gas added to the working medium with the first blower 6 is separated in an air separator 7. Here, the air separator 7 is arranged on the primary side 4*p* in the condenser heat exchanger 4 and separates gaseous components such as air and/or non-condensed working medium. The gaseous components are fed to the first blower 6 via a compressor 13. The turbine 3 can be designed for operation with a mixture of liquid and gaseous components of the working medium. In particular, the turbine 3 is preferably designed as a foam turbine or displacement machine also to be able to work with foam components.

The FIG. 2 shows also on the right side an advantageous arrangement of the cooling tower 20. The cooling water of the cooling circuit 5 fed into the cooling tower 20 is foamed by a cooling tower blower 21. At the same time, a corresponding foaming agent is added to the cooling water. By means of the cooling tower blower 21, outside air is supplied to the cooling water finely dispersed by a compressor 13 to form foam. In addition to water vapor, foam rises through the air heated in the foam bubbles and the total air flow in cooling tower 20. This causes the bubble envelope to transport liquid upwards in the cooling tower 20. The rising air flow with the foam is guided by a spray mist generated by a sprayer 23. The spray mist dissolves the foam and ensures partial condensation of the water vapor. The liquid cooling medium is collected by the arrangement of the sprayer 23 above a collecting tank 22. Air and gaseous parts of the cooling medium can escape via the air exhaust 26. The cooling water collected in collecting tank 22 is led through a downpipe 25 to a water turbine 24. Thus the potential energy of the cooling water may be used to generate electrical energy by means of a generator coupled to the water turbine 24 (not shown). The cooling water is then fed back to condenser 4.

LIST OF REFERENCE NUMERALS

1—first heat exchanger
1*p*—Primary side of the first heat exchanger,
1*s*—Secondary side of the first heat exchanger

2—second heat exchanger
2*p*—Primary side of the second heat exchanger,
2*s*—Secondary side of the second heat exchanger
3—Heat engine, turbine, steam turbine, foam turbine
4—Condensation heat exchanger, condenser
4*p*—Primary side of the condensation heat exchanger
4*s*—Primary side of the condensation heat exchanger
5—Cooling circuit
6—Gas blower
7—Air separator
10—Heat source, combustion device
11—Generator
12—Feed pump
13—Compressor
20—Cooling tower
21—Cooling tower blower
22—Collection tank
23—Sprayer
24—Water turbine
25—Downpipe
26—Air exhaust
27—Compressor, blower

The invention claimed is:

1. A method to convert heat into kinetic energy using at least two heat exchangers to heat a working medium, a heat engine, and a condenser, the method comprising:

the working medium consists of at least two substances, a first thermal energy is supplied in a first heat exchanger to the working medium flowing on a secondary side of the first heat exchanger, wherein the working medium evaporates at least partially and a secondary thermal energy is supplied in a second heat exchanger to the working medium flowing on a secondary side of the second heat exchanger, wherein the working medium continues evaporating, subsequently the working medium is further evaporated using a heat source and is conducted into the heat engine and produces mechanical work using the heat engine, the working medium is then partially condensed on a primary side of the first heat exchanger, heat being transferred to the working medium flowing on the secondary side of the first heat exchanger, and subsequently further condensation heat is transferred to a cooling circuit in a condensation heat exchanger on a primary side of the condensation heat exchanger, and subsequently the working medium is again conducted to the secondary side of the first heat exchanger, and separating gaseous fractions of the working medium in the condensation heat exchanger on the primary side of the condensation heat exchanger, and injecting the separated gas, the injected gas is finally dispersed by a gas blower directly upstream of or in the first heat exchanger, wherein a foaming agent is added to the working medium in the first heat exchanger.

2. The method to implement a cooling circuit according to claim 1, the method further comprises heating a cooling medium in the condensation heat exchanger which is passed into a cooling tower, wherein the cooling medium is displaced by a foaming agent and air is blown in via a cooling tower blower, as a result of which the cooling medium is foamed, and the air trapped in the foam being heated and the foamed cooling medium subsequently rising by thermal lift to a collecting container, wherein the foamed cooling medium is guided by spray jets of a sprayer arranged above a collecting tank, wherein the foam in the cooling tower dissolves by the spray jets and gaseous cooling medium condenses and subsequently liquid is led out of the collecting tank via a water turbine and subsequently is fed again to the condensation heat exchanger.

3. A system to convert heat into kinetic energy comprising:

a first heat exchanger on a secondary side is connected to a second heat exchanger on the secondary side and the second heat exchanger on the secondary side is connected to a pressure side of a heat engine, furthermore an expansion side of the heat engine is connected to a primary side of the first heat exchanger the primary side of the first heat exchanger is subsequently connected to a primary side of a condensation heat exchanger, wherein the condensation heat exchanger is connected on a secondary side a cooling circuit and subsequently the primary side of the condensation heat exchanger is connected to the secondary side of the first heat exchanger, and wherein the primary side of the condensation heat exchanger is formed with an air separator, wherein the air separator is connected to a first blower arranged on the secondary side of the first heat exchanger, a heat carrier comprises a foaming agent, and the secondary side of the second heat exchanger is arranged above the secondary side of the first heat exchanger.

4. The system to convert heat into kinetic energy according to claim 3, wherein the working medium is a mixture of at least two substances with different boiling points, preferably water and alcohol and/or CFC (Chlorofluorocarbon)-free refrigerant.

5. The system to convert heat into kinetic energy according to claim 3, wherein the secondary side of the first heat exchanger and the secondary side of the second heat exchanger are formed in a tank.

6. The system to convert heat into kinetic energy according to claim 3, wherein;

a cooling medium displaced by the foaming agent is connected to the bottom of a cooling tower by means of the cooling circuit, furthermore a cooling tower injector is arranged at the bottom of the cooling tower, wherein the cooling tower blower is connected to a compressor/blower, a sprayer is arranged in the head of the cooling tower above a collecting tank with an air exhaust, and the collecting tank is connected to a water turbine by a downpipe.

* * * * *